US007991314B2

(12) United States Patent
LeStrange et al.

(10) Patent No.: US 7,991,314 B2
(45) Date of Patent: Aug. 2, 2011

(54) IN SITU ELECTROPHOTOGRAPHIC PRINTER TONER CHARGE MEASUREMENT

(75) Inventors: Jack T. LeStrange, Macedon, NY (US); Joseph C. Sheflin, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 21 days.

(21) Appl. No.: 12/625,899

(22) Filed: Nov. 25, 2009

(65) Prior Publication Data

US 2011/0123206 A1 May 26, 2011

(51) Int. Cl.
*G03G 15/06* (2006.01)

(52) U.S. Cl. ..... 399/56; 399/48; 399/49; 399/53; 399/253

(58) Field of Classification Search ..... 399/48, 399/49, 53, 56, 253
See application file for complete search history.

(56) References Cited

U.S. PATENT DOCUMENTS

| | | | | |
|---|---|---|---|---|
| 5,212,522 | A | 5/1993 | Knapp | |
| 5,937,229 | A * | 8/1999 | Walgrove et al. | 399/66 |
| 6,885,833 | B2 * | 4/2005 | Stelter et al. | 399/48 |
| 2003/0138257 | A1 * | 7/2003 | DiRubio et al. | 399/9 |
| 2007/0071473 | A1 * | 3/2007 | Haraguchi et al. | 399/53 |
| 2007/0140713 | A1 * | 6/2007 | Shima | 399/26 |

FOREIGN PATENT DOCUMENTS

| | | | |
|---|---|---|---|
| JP | 06130768 | A * | 5/1994 |
| JP | 2000047470 | A * | 2/2000 |

* cited by examiner

*Primary Examiner* — David M Gray
*Assistant Examiner* — G. M. Hyder
(74) *Attorney, Agent, or Firm* — Oliff & Berridge, PLC

(57) ABSTRACT

A systems and methods for providing an image forming machine capable of monitoring the absolute charge to mass ratio of toner and dielectric thickness of a photoconductor layer on a photoconductor in an image forming device, and for providing warnings, alerts and process controls when the absolute charge to mass ratio of toner in an image forming device or the dielectric thickness of a photoconductor layer falls outside a predetermined range.

18 Claims, 7 Drawing Sheets

IN SITU ELECTROPHOTOGRAPHIC PRINTER TONER CHARGE MEASUREMENT

BACKGROUND

This disclosure is directed to systems and methods for measuring an absolute charge to mass ratio of toner and a dielectric thickness of a photoconductor layer on a photoconductor in an image forming device, and for providing process control feedback, and diagnostic warnings or alerts when the absolute charge to mass ratio of toner in the image forming device or the dielectric thickness of a photoconductor layer falls outside a predetermined range of acceptable values to support image production.

In an electrophotographic image forming device, images are formed as electrostatic patterns on a surface. Typically, the surface consists of a cylinder or belt with a photoconductive material coated on an outer surface of the cylinder or belt. Electrostatic charge is deposited on the surface of the photoconductor layer. A light source is directed at the photoconductor layer surface in accordance with an image to be formed. Where the light source strikes the surface, the electrostatic charge on the surface is discharged in accordance with the light received at that point on the surface leaving an electrostatic charge pattern, or latent electrostatic image, that corresponds to at least a portion of the image to be formed. The photoconductor layer surface is then contacted with toner particles that carry a charge. Charged toner particles are attracted to, or repelled from, areas of the photoconductor layer that are electrostatically charged.

Toner collects on areas of the photoconductor layer to cancel the electrostatic potential on the surface of the photoconductor layer at any position until no further toner particles are attracted to that area. Therefore, the density of toner particles at any particular point on the surface of the photoconductor layer will be proportional to the charge on the surface of the photoconductor layer.

The toner is subsequently transferred from the photoconductor layer to an image receiving medium, such as, for example, paper or plastic substrates. The toner image is then fixed to the image receiving medium by, for example, heating the toner on the medium to fuse the toner particles to the medium with a combination of heat and pressure.

Because the amount of toner attracted to any part of the surface of the photoconductor layer is proportional to the surface charge on the photoconductor layer and the charge on the toner particles, the charge to mass ratio of the toner particles will affect the density of toner that adheres to the photoconductor layer. If the quantity of charge per unit mass of toner is high, the charge on the photoconductor layer surface will be balanced by only a small quantity of toner. On the other hand, if the charge per unit mass of toner is low, a large quantity of toner will be required to balance the charge on the photoconductor layer. Therefore, the contrast of any formed image depends on the charge to mass ratio of the toner particles. Accurate control of an absolute value of toner particle change to mass ratio is, therefore essential to maintaining high image quality (IQ) in formed images.

Every effort is made to produce toner with a consistent charge to mass ratio. This ratio, however, may vary for a number of reasons. These reasons may include changes in manufacturing processes of the toner particles, changes in humidity and temperature of the atmosphere that surround the toner particles both in storage and in use, exposure to light or other forms of radiation, contact of toner particles with surfaces that transfer charge to or from the toner particles, aging of the toner particles and processes that agitate, mix or move the toner particles.

Systems for measuring how a relative charge to mass ratio varies with time, and adjusting a device to account for variance and attempting to maintain a constant relative charge to mass ratio are known. For example, U.S. Pat. No. 5,212,522 to Knapp teaches a method for attempting to maintain a constant relative charge to mass value. This system discloses placing a known charge per unit area onto a photoconductor. The electrostatic charge potential of the photoconductor cylinder before and after developing the image with toner is measured. The difference between the two potentials is used to calculate the relative charge per unit area of the toner. The mass per unit area of toner may be determined by, for example, an optodensitometer that measures the reflected light from the toner on the photoconductor, the frequency shift of a piezo device that has toner particles attracted to its surface from a known photoconductor area, or by measuring the voltage discharge rate of a photoconductor exposed to light through the toner layer. Using these pieces of information, relative charge per unit mass of the toner is determined. The system then takes various steps to compensate for changes in the relative charge to mass ratio in order to maintain IQ. The method disclosed in this patent, however, has limitations. Among these limitations are that the surface voltage measurements before and after development with toner depend on the state of the photoconductor layer. It is known that photoconductor layer properties may creep or change with time due to, for example, aging and wear. Such changes in the physical properties of the photoconductive layer will have a significant impact on the value of the calculated relative charge to mass ratio determined by systems such as the one disclosed in Knapp. Further, the calculated relative charge to mass ratio will be adversely affected by properties of the toner particles themselves. For example, the diameter of toner particles will have a significant impact on calculated relative charge to mass ratios.

These and other deficiencies mean that the system disclosed in Knapp will be able to compensate for changes in relative charge to mass ratios of the toner, but unable to compensate for specific changes in the photoconductor layer and the toner particles themselves. Changes to the photoconductor layer and toner may also fool the systems into compensation for changes in relative charge to mass ratio that do not exist, or compensation by an incorrect amount. Because systems such as Knapp do not calculate absolute values for the charge to mass ratio of the toner particles, these systems cannot determine if the absolute charge to mass ratio has reached a point where compensation is no longer possible because the absolute charge to mass ratio is either so high or so low that the compensation will no longer be effective. This means that the image forming devices will form images with poor IQ with no indication to a user that there is any issue with the image forming device based on charge to mass ratio of the toner particle.

SUMMARY

In view of the above, it would be advantageous to develop a system and method to measure an absolute charge to mass ratio of toner in an image forming device during normal operation. Further, it would be advantageous to provide a system and method to measure the condition of the photoconductor layer and the photoconductor in general.

In exemplary embodiments, the systems and methods according to this disclosure may provide a manner by which to determine an absolute measure of the charge to mass ratio of the toner in an image forming device during normal operation.

In exemplary embodiments, the systems and methods according to this disclosure may provide a manner by which to measure the dielectric thickness of the photoconductor layer on a photoconductor during normal operation of an image forming device.

In exemplary embodiments, the systems and methods according to this disclosure may provide a compensation for the size and dielectric constant of toner particles when calculating the absolute charge to mass ratio of the toner in an image forming device during normal operation.

In exemplary embodiments, the systems and methods according to this disclosure may provide a control system to improve machine IQ performance based on a measurement of absolute change to mass ratio in an image forming device.

In exemplary embodiments, the systems and methods according to this disclosure may provide diagnostic system or user alerts and warning signals for users or service providers or manufacturers of an image forming device when an absolute charge to mass ratio of a toner or dielectric thickness of a photoconductor layer, are outside of ranges that can produce acceptable IQ.

In exemplary embodiments, the systems and methods according to this disclosure may cause shutdown of an image forming device when a measure of an absolute charge to mass ratio of a toner, or a measure of a dielectric thickness of a photoconductor layer of a photoconductor, are outside of ranges that can produce acceptable IQ.

These and other features and advantages of the disclosed systems and methods, are described in, or apparent from, the following detailed description of various exemplary embodiments.

BRIEF DESCRIPTION OF THE DRAWINGS

Various exemplary embodiments of the disclosed systems and methods for toner absolute charge to mass ratio measurement and monitoring, photoconductor layer dielectric thickness, measurement and monitoring and, control and reporting are described, in detail, with reference to the following drawings wherein.

EMBODIMENTS

Figure 1:
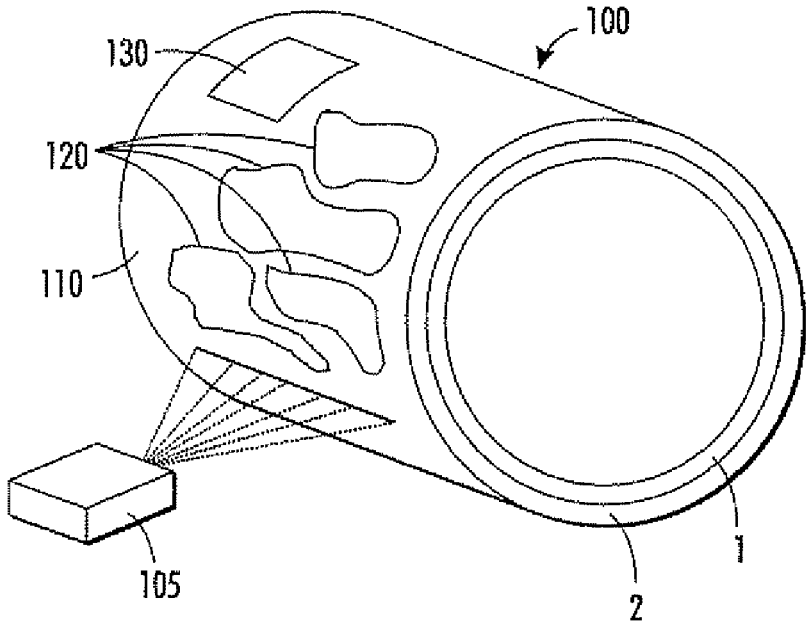
FIG. 1 illustrates an exemplary embodiment of a photoconductor cylinder for an electrophotographic image forming device that will benefit from the systems and methods according to this disclosure.

The following embodiments illustrate examples of systems and methods for measuring absolute charge to mass ratio of toner, and photoconductor layer dielectric thickness, in an image forming device, and for adjusting the image forming device to compensate for changes in these parameters, as well as reporting changes detrimental to IQ. The following description of various exemplary embodiments for measuring absolute charge to mass ratio of toner, and photoconductor layer dielectric thickness, in an image forming device may refer to one specific type of xerographic image forming device, such as, for example, a particular polarity of toner particle charge or method of forming a latent electrostatic image, for the sake of clarity, and ease of depiction and description. Terms associated with such usage forming devices and operations may be used that will include photoconductor layers, and light sources as means for forming latent charge images on photoconductor layers. It should be recognized that, although the systems and methods according to this disclosure may be applicable to, for example, a xerographic image forming device of a particular kind, these depictions and/or descriptions are not intended to be limited to any specific device or method.

Any system and/or method for image forming that may advantageously apply measurement of an absolute charge to mass ratio of toner, or of a photoconductor layer dielectric thickness, or the dielectric thickness of any other medium used to form a latent electrostatic image according to this disclosure, is contemplated. In referring to, for example, image forming devices, such devices may include, but are not limited to, copiers, printers, scanners, facsimile machines, using electrostatic electrophotographic xerographic processes for image forming, and/or any other now known or later-developed system or device for producing, reproducing and/or potentially transmitting or receiving monochrome or color images.

Properties of components and consumables used in image forming devices such as, for example, photoconductor cylinders, and belts, and toner vary with time due to changes in environmental conditions like temperature and humidity, wear of components due to use, aging of the components because of decomposition, and like factors that cause degradation of these materials. Therefore, IQ of output image from an image forming device will vary with time. The IQ of an individual images may also be different from that of preceding and succeeding images for various reasons, these include the recent history of the image forming device, such as how many images have been formed in a specified recent period of time, what kind of images have been formed and when the machine was last powered up. In particular, this disclosure concerns changes in the absolute charge to mass ratio of toner particles, variation in the dielectric thickness of photoconductor layer on a photoconductor, and variation in toner dielectric thickness.

Therefore, one aspect of this disclosure is the use of a systems and methods for measuring absolute charge to mass ratio of toner, and for measuring photoconductor layer dielectric thickness, in an image forming device and reporting changes detrimental to IQ.

FIG. 1 shows, in this embodiment, a photoconductor cylinder 100 for an image forming device. The photoconductor cylinder 100 includes an inner conductor material 1 that is coated with a photoconductor layer 2. The inner conductor material 1 may be held at any suitable potential voltage depending on (1) the kind of electrophotographic reproduction being performed, (2) the toner type and (3) the specific photoconductor layer 2 used, among other variables. When the photoconductor cylinder 100 is not exposed to light or radiation, the photoconductor layer 2 forms an effective insulator between the outer surface 110 of the photoconductor layer 2 and the inner conductor material 1. However, when light is shone on photoconductor layer 2, the areas exposed to light become conducting so that charge can move between surface 110 of the photoconductor layer 2 and the inner conductor material 1. The photoconductor layer 2 and inner conductor material 1 need not be a formed in the shape of a cylinder, and any shape suitable for image reproduction may be used in combination with the other features disclosed.

In an electrophotographic image fowling device, an exemplary method of producing a toner image is as follows. The surface 110 of the photoconductor layer 2 is given a constant surface charge while the photoconductor cylinder 100 is held in a dark space. The photoconductor cylinder 100 then rotates past either a scanning laser 105, or alternate light source that can be modulated, that illuminates the photoconductor layer 2. Where light impinges on the photoconductor layer 2, the photoconductor layer 2 discharges surface charge to the inner conductor material 1. The light of the laser 105, or alternate light source, is modulated in a manner to produce a latent charge distribution on the surface 110 of the photoconductor layer 2 that corresponds to an image to be formed 120. As well as the image to be formed 120, the laser 105, or alternate light source, may also produce separation tone patches 130 that are separate from the images to be formed 120. These separation tone patches 130 may be used by various sensors in the machine to measure the ongoing electrophotographic process. The latent electrostatic image 120 on the surface 110 of the photoconductor cylinder 100 is then developed to form a toner image and transferred to an image receiving medium (not shown).

The development process may involve toner particles charged in the same or opposite polarity to the surface charge on the photoconductor layer 2. The inner conductor material 1 may be held at a positive, negative or ground voltage depending on the development method and toner.

The relationship between the charge on the surface of the photoconductor layer 2 and the surface potential may be represented as a capacitance per unit area of the photoconductor cylinder 100.

Figure 2:
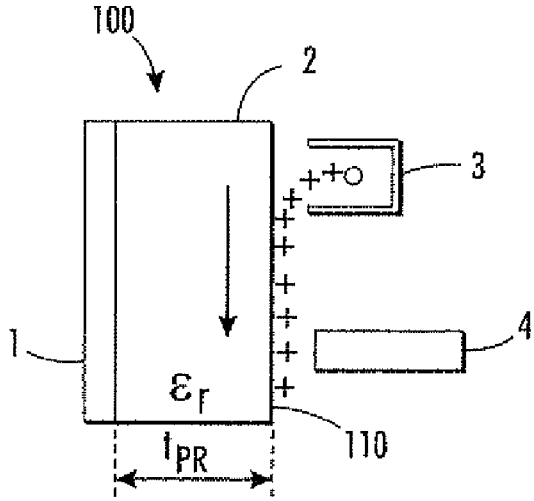
FIG. 2 illustrates an exemplary embodiment of a device for measuring photoconductor layer dielectric thickness according to this disclosure.

FIG. 2 shows a section of the photoconductor cylinder 100 with the inner conductor material 1 and a photoconductor layer 2 in its insulating state. A constant current ion charging device 3, often referred to in certain embodiments as a corotron, may be used to deposit a constant charge per unit area on the surface 110 of the photoconductor layer 2. If the charging device 3 produces a constant ion current I, then the charge $q_{corotron}$ produced in a time T, may be represented by Equation 1 as follows:

$$q_{corotron}=IT \quad \text{(Equation 1)}$$

In this exemplary embodiment, the photoconductor layer 2 moves at a constant speed past the charging device 3. The above charge will be distributed on an area, a, of the photoconductor layer 2 that sweeps past the charging device 3 in time T.

If the thickness of the photoconductor $t_{(PR)}$ is much smaller than the size of the area swept then the capacitance of the area can be approximated as a parallel plate capacitor with dielectric thickness of the photoconductor $t_{d(PR)}$ and capacitance of this area of the photoconductor $C_{P/R}$ may be represented by Equation 2 as follows:

$$C_{P/R} = \frac{\varepsilon_o a}{t_{d(PR)}} \quad \text{(Equation 2)}$$

where $\in_0$ is the permittivity of free space constant ($8.85\times10^{-12}$ F/m). The dielectric thickness ($t_d$) of a material being the thickness of the material divided by the relative dielectric constant, $\in_r$, of the material forming the capacitor.

The potential difference $V_{corotron}$ between the inner conductor material 1 and the surface of the photoconductor layer 110 and the charge $q_{corotron}$ on the surface 110 of the photoconductor layer 2 may be represented by Equation 3 as follows:

$$q_{corotron}=C_{P/R}V_{corotron} \quad \text{(Equation 3)}$$

Substituting into Equation 3 for $C_{P/R}$ from Equation 2 and a $q_{corotron}$ from Equation 1 and rearranging gives the dielectric thickness of the photoconductor layer ($t_{d(PR)}$) yields Equation 4 as follows:

$$t_{d(PR)} = \frac{\varepsilon_o V}{I}\frac{a}{T} \quad \text{(Equation 4)}$$

The term $$\frac{a}{T}$$

(area per unit time of the system) in Equation 4, is the product of machine process speed and the effective width of the constant current device. Therefore, the value for a specific device is known. The voltage across the photoconductor layer 2 can be determined from the difference between the voltage on the surface 110 of the photoconductor layer 2 detected by, for example, a non-contact electrostatic voltage (ESV) sensor 4, and the voltage on the inner conductor material 1. In the manner using Equation 4, the dielectric thickness of the photoconductor layer 2 may be derived.

Figure 3:
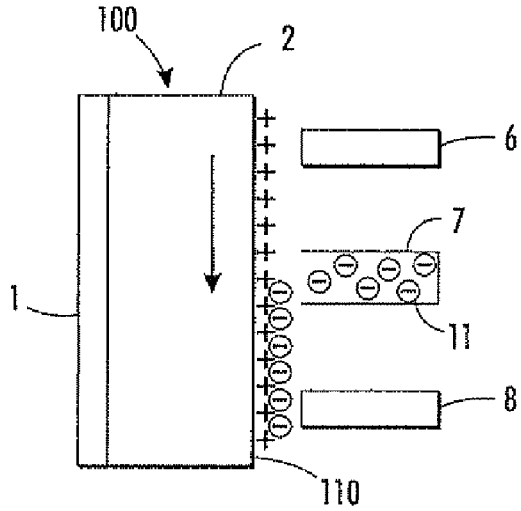
FIG. 3 illustrates an exemplary embodiment of a device for measuring charge per unit area of toner on a photoconductor layer which when combined with a measurement of mass per unit area of toner on a photoconductor layer produces a measurement of absolute charge to mass ratio of the toner according to this disclosure.

FIG. 3 shows the situation before and after an area has been developed with toner 10. The charge on the toner particles, $q_{toner}$, like the charge from the charging device 3 ($q_{corotron}$) cause a potential to form between the inner conductor material 1 and the surface of the toner 10 attached to the photoconductor layer 2. One might expect, therefore, that the voltage across the photoconductor layer 2 would change in proportion to the charge on the toner particles and the capacitance of the photoconductor layer 2 ($C_{P/R}$). However, the toner particles 10 have a finite size, and the charge on each of the toner particles 10 attached to the surface 110 of the photoconductor layer 2 will not be situated at the surface 110 of the photoconductor layer 2, but will be situated some fraction of the radius of the toner particles 10 from that surface. Further, the dielectric constant of the toner particles 10 is not necessarily the same as that of the photoconductor layer 2.

One way to account for the finite size of the toner particles 10 is to model the layer of toner particles 10 as a second parallel plate capacitor in series with the photoconductor layer 2. The total capacitance, $C_{total}$, may then be derived from the photoconductor layer 2 capacitance ($C_{P/R}$), and the capacitance of the layer of toner particles 10, $C_{toner}$, and represented by Equation 5 as follows:

$$C_{total} = \frac{1}{\frac{1}{C_{P/R}} + \frac{1}{C_{toner}}} \quad \text{(Equation 5)}$$

The capacitance of the layer of toner particles 10 $C_{toner}$ also be modeled, as shown in Equation 6 below, as a parallel plate capacitor with a dielectric thickness, $t_{d(toner)}$, and may be represented by Equation 6 as follows:

$$C_{toner} = \frac{\varepsilon_o a}{t_{d(toner)}} \quad \text{(Equation 6)}$$

The dielectric thickness of the developed toner ($t_{d(toner)}$) can be calculated from the ratio of mean radius of the toner particles 10, $r_{toner}$ and the relative dielectric constant of the toner resin $\kappa_{toner}$. Because of the geometry of, and interstitial air spaces between, neighboring particles the above ratio must be multiplied by an empirically determined scaling factor of 0.32 to account for the above features, Thus, the toner dielectric thickness of the toner particles ($t_{d(toner)}$) may be approximated by Equation 7 as follows:

$$t_{d(toner)} = \frac{0.32 r_{toner}}{\kappa_{toner}} \quad \text{(Equation 7)}$$

Substituting into Equation 5 for $C_{P/R}$ from Equation 2 and $C_{toner}$ from Equation 6 and rearranging the variables yield a different equation for the total series capacitance ($C_{total}$) of the photoconductor layer 2 and the layer of toner particles 10 toner that may be represented by Equation 8 as follows:

$$C_{total} = \frac{\varepsilon_o a}{t_{d(PR)} + t_{d(toner)}} \quad \text{(Equation 8)}$$

The change in potential difference ΔV between the inner conductor material 1 and the toner surface 112 due to the charge on the layer of toner particles 10, $q_{toner}$, can be measured by non-contact ESV sensors 6, 8 placed before and after the layer of toner particles 10 is deposited by toner developer 7, on the surface 110 of the photoconductor layer 2, and may be represented by Equation 9 as follows:

$$q_{toner} = C_{total} \Delta V \quad \text{(Equation 9)}$$

Substituting into Equation 9 for $C_{total}$ from Equation 8 and rearranging the variables yields a new equation for the toner charge per unit area $$\frac{q_{toner}}{a}$$

that may be represented by Equation 10 as follows:

$$\frac{q_{toner}}{a} = \frac{\varepsilon_o \Delta V}{t_{d(PR)} + t_{d(toner)}} \quad \text{(Equation 10)}$$

The toner mass per unit area $$\frac{m_{toner}}{a}$$

can be measured in a number of ways as discussed in above. Given a value for the toner mass per unit area $$\left(\frac{m_{toner}}{a}\right)$$

determined by one or more of these methods, the absolute toner charge to toner mass ratio, $$\frac{q_{toner}}{m_{toner}},$$

may be represented by Equation 11 as follows:

$$\frac{q_{toner}}{m_{toner}} = \frac{q_{toner}/a}{m_{toner}/a} \quad \text{(Equation 11)}$$

Substituting into Equation 11 for $$\frac{q_{toner}}{a}$$

from Equation 10 and rearranging the variables yields a new equation for the absolute toner charge to toner mass ratio $$\left(\frac{q_{toner}}{m_{toner}}\right)$$

that an be represented by Equation 12 as follows:

$$\frac{q_{toner}}{m_{toner}} = \frac{\varepsilon_o \Delta V}{t_{d(PR)} + t_{d(toner)}} \frac{1}{m/a} \quad \text{(Equation 12)}$$

The sum of the dielectric thickness of the toner particles ($t_{d(toner)}$) and the dielectric thickness of the photoconductor layer ($t_{d(PR)}$) represents a combined dielectric thickness of the toner and photoconductor layer, $t_{D\ eff}$ that may be represented by Equation 13 as follows:

$$t_{D\ eff} = t_{d(PR)} + t_{d(toner)} \quad \text{(Equation 13)}$$

Substituting into Equation 12 for $t_{D\ eff}$ from Equation 13 yields an alternate equation for the toner charge to toner mass ratio $$\left(\frac{q_{toner}}{m_{toner}}\right)$$

that can be represented by Equation 14 as follows $$\frac{q_{toner}}{m_{toner}} = \frac{\varepsilon_o}{t_{Deff}} \frac{\Delta V}{m/a} \quad \text{(Equation 14)}$$

Thus, Equations 12 and 14 can be used to calculate the absolute toner charge to toner mass ratio $$\left(\frac{q_{toner}}{m_{toner}}\right),$$

if the change in voltage due to the development of an image ($\Delta V$), the mass per unit area in the developed image $$(m/a)$$

and the dielectric thickness of the toner ($t_{d(toner)}$) and photoconductor layer ($t_{d(PR)}$) are known.

Equation 12 also demonstrates that any value of the absolute toner charge to toner mass ratio calculated based on the change in potential when an electrostatic image is developed, also depends on the toner dielectric thickness ($t_{d(toner)}$) and photoconductor layer dielectric thickness ($t_{d(PR)}$). If these values remain constant with time, then an image forming device may be calibrated to produce good IQ based on experiment. If the image forming device then adjusts parameters to account for any change in the measured value of $$\frac{\Delta V}{m/a},$$

as in U.S. Pat. No. 5,212,522, the IQ will remain constant. If, however, the value of the dielectric thickness of the toner ($t_{d(toner)}$) and photoconductor layer ($t_{d(PR)}$) change, the value of $$\frac{\Delta V}{m/a}$$

alone cannot be relied upon to maintain IQ.

Equation 4 provides a way to measure the dielectric thickness of the photoconductor ($t_{d(PR)}$) based on the voltage ($V_{corotron}$) measured on the surface of photoconductor layer 2 after the known charge per unit area has been placed on a bare surface of the photoconductor layer 2 by, for example, a charging device 3 emitting a constant current (I) at an area per unit time $$\left(\frac{a}{T}\right).$$

This measurement may be performed at any time during machine operation when the measured surface of the charged photoconductor layer 110 is known to be devoid of toned images, for example, during machine cycle up and cycle down operations.

Figure 5:
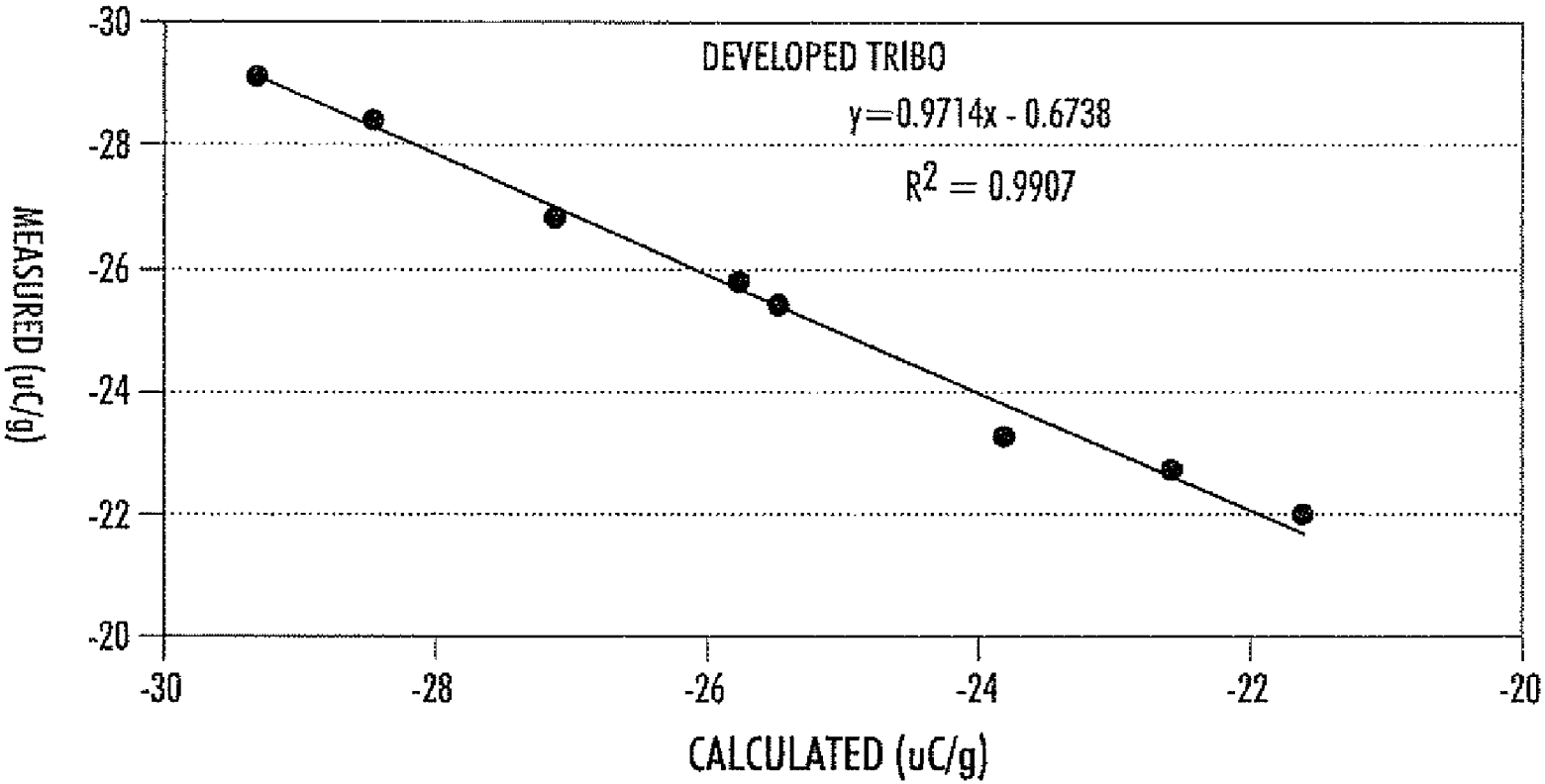
FIG. 5 illustrates an exemplary embodiment of experimental data for verifying the devices and methods for monitoring the absolute charge to mass ratio of toner.

FIG. 5 shows experimental verification of the above techniques. In FIG. 5, the calculated absolute toner charge to toner mass ratio, base on the above measurements and Equation 12, is compared to the absolute toner charge to toner mass ratio determined independently by measuring the charge on a known mass of toner in a Faraday cage. In this case, the absolute toner charge to toner mass ratio was varied by changing a concentration of toner in the developer housing of the image forming device. The various data points are for different photoconductor layers with different photoconductor layer dielectric thicknesses. Thus, FIG. 5 demonstrates the effectiveness of Equation 12 that includes the toner and photoconductor layer dielectric thicknesses for predicting the absolute toner charge to toner mass ratio.

Figure 4:
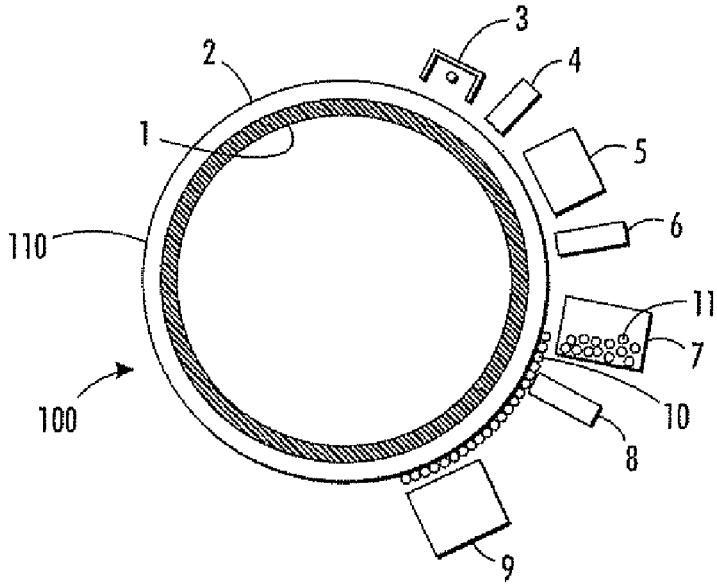
FIG. 4 illustrates an exemplary embodiment of components in an image forming device for measuring dielectric thickness of a photoconductor layer, charge per unit area of toner on a photoconductor layer and mass per unit area of toner on a photoconductor layer to produce an absolute measurement of charge to mass ratio of the toner according to this disclosure.

FIG. 4 shows an exemplary embodiment of a device for monitoring photoconductor dielectric thickness and absolute toner charge to toner mass ratio on a photoconductor cylinder 100 with a photoconductor layer 2 and inner conductor material 1. Charging device 3 is used to charge the photoconductor layer surface 110 with a known charge.

A non-contact ESV sensor 6 placed, for example, immediately after a latent image is formed by exposure source 5, but before toner developer 7 may be used to measure the surface voltage ($V_{corotron}$) in order to calculate the dielectric thickness of the photoconductor layer 2.

Non-contact ESV sensor 6, however, is not the optimum position of a non-contact electrostatic voltage sensor for measuring the surface voltage ($V_{corotron}$) in order to calculate the dielectric thickness of the photoconductor layer 2. One reason is that exposure source 5 may indirectly expose areas such as separation tone patch 130 to light. This indirect exposure may be due to light scattered while exposing other areas of the photoconductor layer to form the latent charge image. This indirect exposure may discharge some of the charge on the surface 110 of photoconductor layer 2, and produce an incorrect value for photoconductor layer dielectric thickness ($t_{d(PR)}$). Thus, although the measurement may be carried out by non-contact electrostatic voltage sensor 6, any measurement of photoconductor layer dielectric thickness ($t_{d(PR)}$) is preferably performed immediately after the charging device 3 by a separate non-contact ESV sensor 4. Measurement by ESV sensor 4 has the further advantage that the surface of the photoconductor layer 2 is free of any residual toner particles, and there is little time for any dark decay of the surface charge before the measurement. Dark decay indicates a slow leakage of charge from the surface of the photoconductor layer 2 due to the photoconductor not being a perfect insulator even in the dark.

More preferable is to perform the measurement only at the beginning of a print job, or startup of the image forming device. Because the photoconductor layer dielectric thickness ($t_{d(PR)}$) varies only slowly with time, or changes abruptly when a photoconductor cylinder 100 is replaced, infrequent measurement is acceptable. Performing the measurement only at the above times, also helps to ensure that the photoconductor surface is free of residual toner.

Non-contact ESV sensor 6 measures the pre toner development surface potential of one or more single separation tone patches 130. Non-contact ESV sensor 8 is then used to measure the post toner development surface potential of the one or more single separation tone patches 130. This gives $\Delta V$ for Equations 12 or 14 to calculate the absolute toner charge to toner mass ratio $$\left(\frac{q_{toner}}{m_{toner}}\right).$$

The $$\frac{m_{toner}}{a}$$

ratio for the one or more single separation tone patches 130 may be measured by a toner densitometer 9.

This leaves just the value of the dielectric thickness of the toner $t_{d(toner)}$. This may be obtained in a number of ways, by for example reading a bar code, wireless chip or some other marking or device on a toner cartridge. The data gathered by this reading process may either encode the dielectric thickness of the toner ($t_{d(toner)}$) directly or allow the image foxing device to search for a suitable value for the type and even the particular batch of cartridge indicated by the data gathered.

Using all of the above information the current absolute value of the absolute toner charge to toner mass ratio $$\left(\frac{q_{toner}}{m_{toner}}\right)$$

may be calculated by using Equation 12.

Using the above values determined for the absolute toner charge to toner mass ratio $$\left(\frac{q_{toner}}{m_{toner}}\right)$$

and the photoconductor layer dielectric thickness ($t_{d(PR)}$) allows the image forming device to take a number of actions based on these values.

If the absolute toner charge to toner mass ratio $$\left(\frac{q_{toner}}{m_{toner}}\right)$$

is within a first predetermined toner range, the image forming device may correct the charge supplied by, for example, a charging device 3, the exposure conditions to form the latent electrostatic image and the supply of toner to maintain IQ. Further, if the photoconductor layer dielectric thickness ($t_{d(PR)}$) is within a first predetermined photoconductor range the image forming device may correct the charge supplied by, for example, a charging device 3, the exposure conditions to form the latent electrostatic image and the supply of toner to maintain the IQ.

Figure 6:
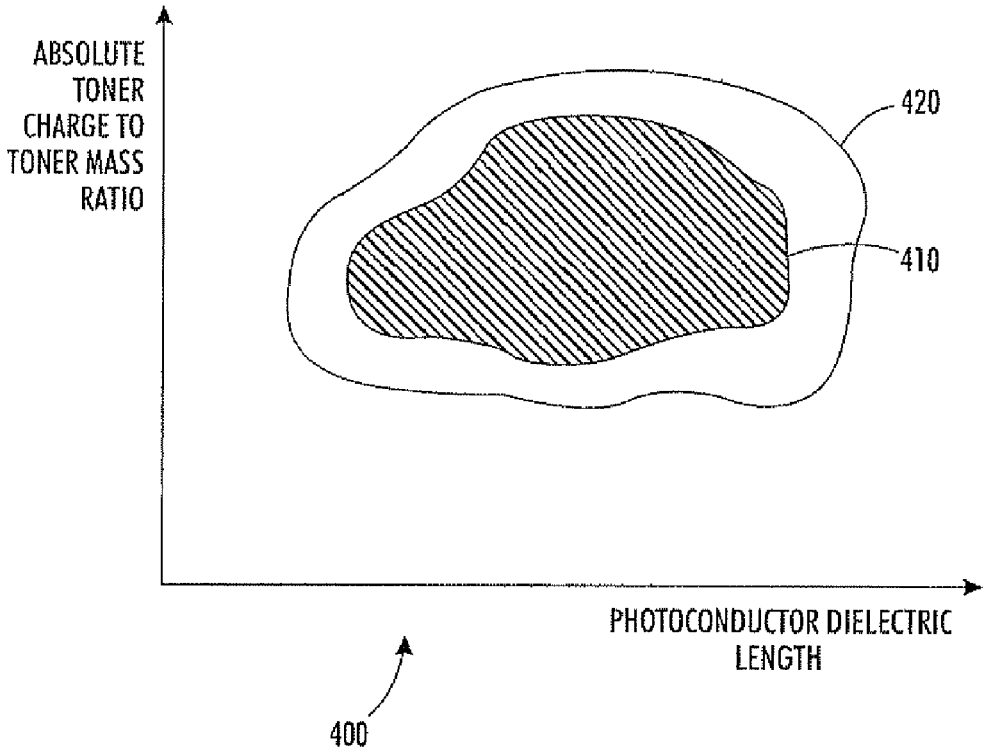
FIG. 6 illustrates an exemplary embodiment of a safe operating area for determining if the IQ will be affected by a combination of absolute charge to mass ratio of toner and photoconductor dielectric thickness.

The image forming device may also calculate a more sophisticated first safe operating area 410 as shown in FIG. 6, based on a combination of the absolute toner charge to toner mass ratio $$\left(\frac{q_{toner}}{m_{toner}}\right)$$

and the photoconductor layer dielectric thickness ($t_{d(PR)}$). The safe operating area defining an acceptable area on a chart 400 of absolute toner charge to toner mass ratio $$\left(\frac{q_{toner}}{m_{toner}}\right)$$

against photoconductor layer dielectric thickness ($t_{d(PR)}$). If this the values of absolute toner charge to toner mass ratio $$\left(\frac{q_{toner}}{m_{toner}}\right)$$

and photoconductor layer dielectric thickness ($t_{d(PR)}$) plotted on such a chart falls within the first safe operating area, the image forming device adjusts conditions, as above, to maintain IQ.

If the absolute toner charge to toner mass ratio $$\left(\frac{q_{toner}}{m_{toner}}\right)$$

is outside of a first toner predetermined range but within a second predetermined toner range, the image forming device may still correct the charge supplied by, for example, a charging device 3, the exposure conditions to form the latent electrostatic Image and the supply of toner to maintain IQ, but also present the results of the absolute toner charge to toner mass ratio. Further, if the photoconductor layer dielectric thickness ($t_{d(PR)}$) is outside of a first predetermined photoconductor range but within a second predetermined photoconductor range the image forming device may still correct the charge supplied by, for example, a charging device 3, the exposure conditions to form the latent electrostatic Image and the supply of toner to maintain IQ, but also present the results of the photoconductor layer dielectric thickness measurement, The image forming device may also calculate the more sophisticated second safe operating area 420 like the first safe operating area 410 as shown in FIG. 6, if the sophisticated calculation shows that the conditions are within the first safe operating area but outside of a second safe operating area, the image forming device may still correct the charge supplied by, for example, a charging device 3, the exposure conditions to form the latent electrostatic Image and the supply of toner to maintain IQ, but also present the results of the more sophisticated second safe operating area 420 along with a warning for a user on a display screen on image forming devices Finally, if the absolute toner charge to toner mass ratio $$\left(\frac{q_{toner}}{m_{toner}}\right)$$

is outside of a second predetermined toner range, if the photoconductor layer dielectric thickness ($t_{d(PR)}$) is outside of a second predetermined photoconductor range, or if the sophisticated calculation shows that the conditions are outside of a second safe operating area 420 as shown in FIG. 6, the image forming device maybe disabled to prevent further use, until the image forming device is repaired. The image forming device may also send out information, as above, to a network administrator, service agent or manufacturer so that the appropriate action to remedy the issue may be taken.

Figure 7:
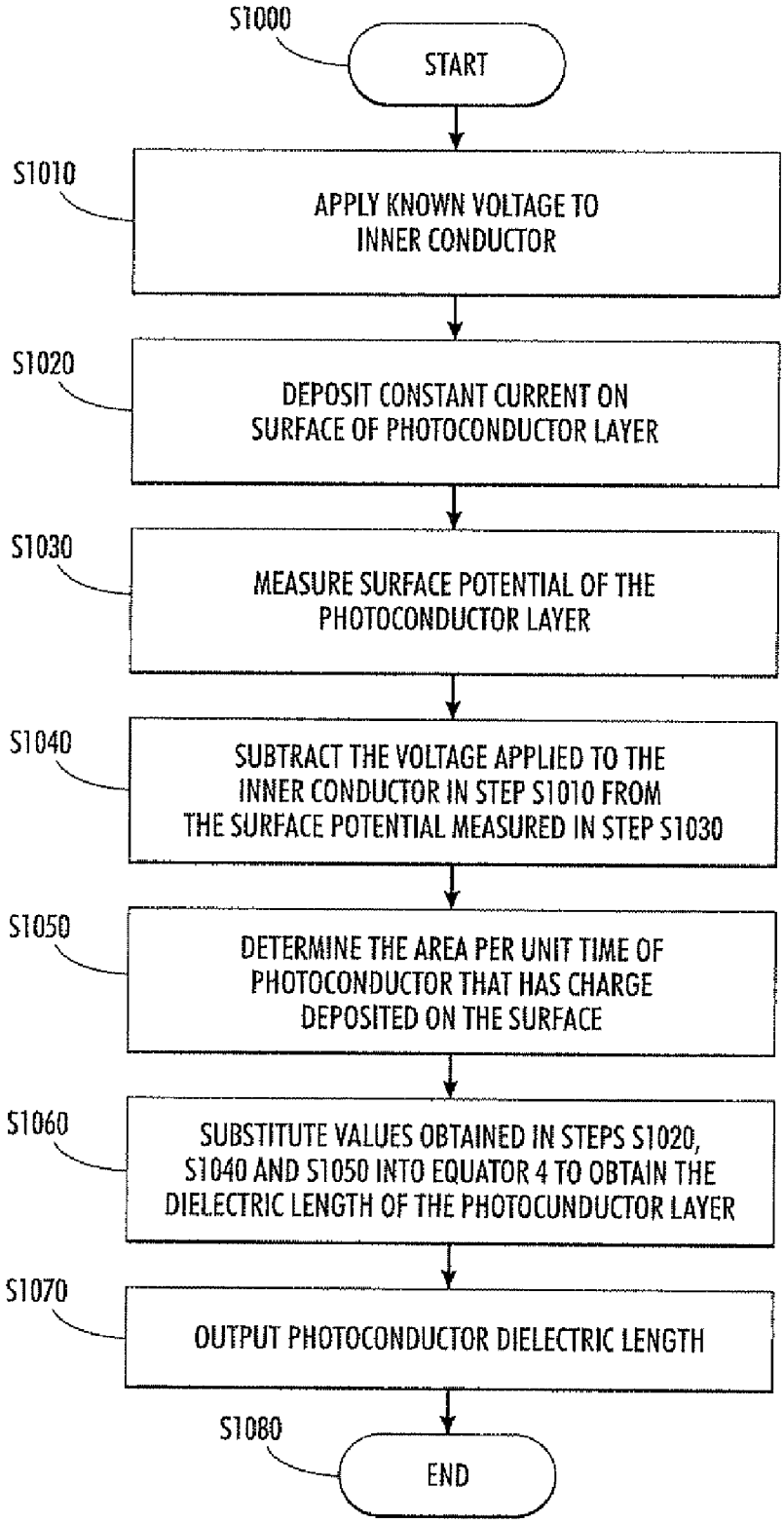
FIG. 7 illustrates an exemplary embodiment of a method for measuring photoconductor layer dielectric thickness according to this disclosure.

FIG. 7 illustrates an exemplary embodiment of a method for measuring photoconductor layer dielectric thickness according to this disclosure.

The method begins at step S1000 and proceeds to step S1010. In step S1010, a known voltage is applied to an inner conductor material of a photoconductor. Operation of the method proceeds to step S1020.

In step S1020, a constant ion current, (I) is deposited on the surface of photoconductor layer. Operation of the method proceeds to step S1030.

In step S1030, a surface potential of the photoconductor layer is measured using a sensor such as a non-contact ESV sensor. Operation of the method proceeds to step S1040.

In step S1040, the voltage due to the constant surface charge deposited on the surface of the photoconductor layer is calculated by subtracting the voltage applied to the inner conductor in step S1010 from the voltage measured by the sensor in step S1030 to find the voltage $V_{corotron}$ due to the constant ion current (I) deposited in step S1020. Operation of the method continues to step S1050.

In step S1050, the area of photoconductor supplied with charge per unit time of the system $$\left(\frac{a}{T}\right)$$

is determined from parameters set in the image forming device. Operation of the method continues to step S1060.

In step S1060, the values for $V_{corotron}$, I and $$\frac{a}{T}$$

are substituted into Equation 4 to determine the photoconductor layer dielectric thickness ($t_{d(PR)}$). Operation of the method continues to step S1070.

In step S1070, the value of the photoconductor layer dielectric thickness $t_{d(PR)}$ is output. The method proceeds to step S1080 where operation of the method ceases.

Figure 8:
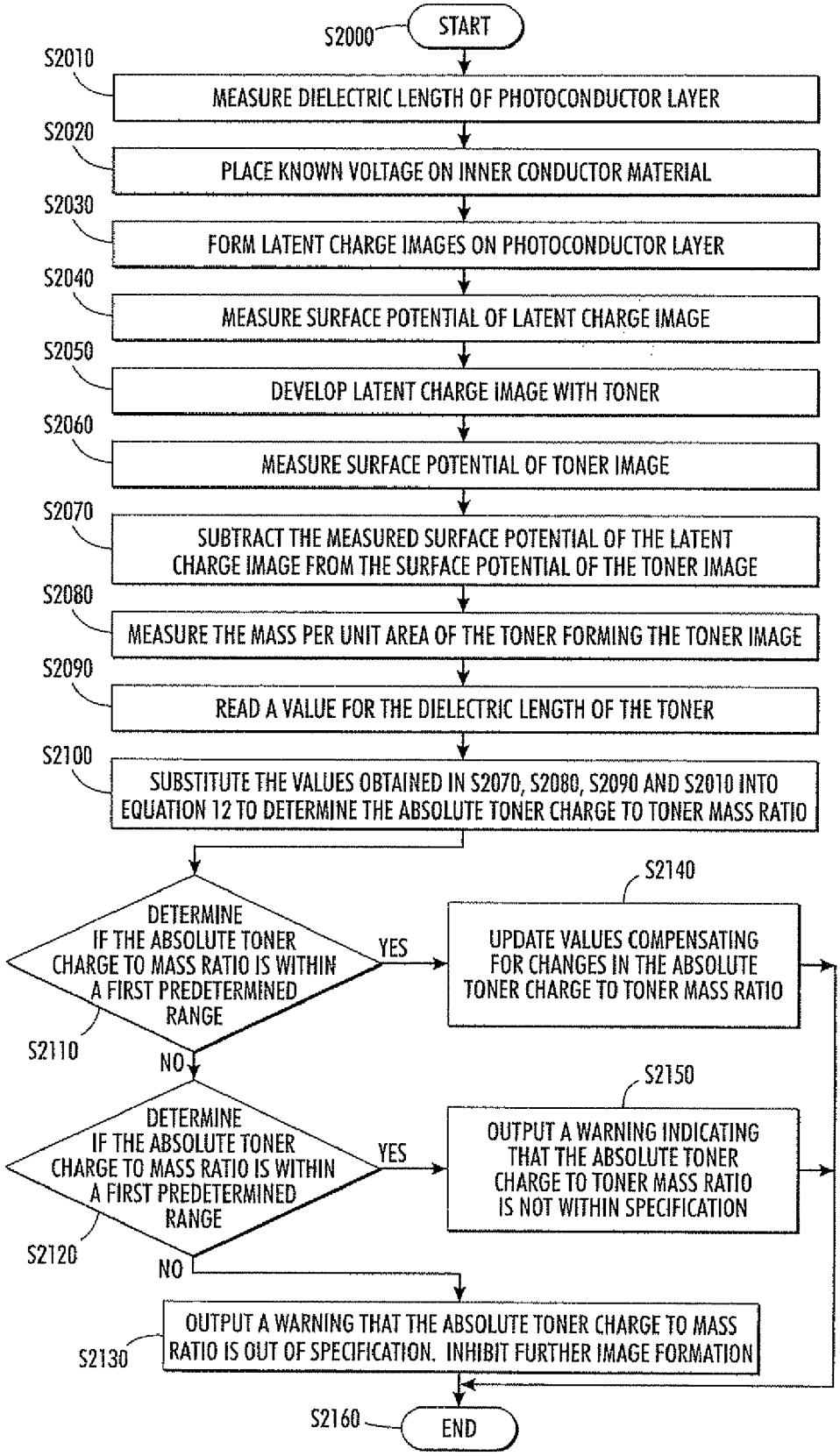
FIG. 8 illustrates an exemplary embodiment of a method for measuring charge per unit area according to this disclosure.

FIG. 8 illustrates an exemplary embodiment of a method for measuring charge per unit area according to this disclosure; and The method begins at step S2000 and proceeds to step S2010. In step S2010, the dielectric thickness of the photoconductor layer ($t_{d(PR)}$) is measured using, for example the method described in steps S1000 through S1080 as described above. Operation of the method proceeds to step S2020.

In step S2020, a known voltage that may be different from that applied in step S1010 is applied to the inner conductor material 1. Operation of the method proceeds to step S2030.

In step S2030, a latent charge image is recorded in the surface 110 of the photoconductor layer 2. The latent charge image corresponds to an image 120 to be formed by the image forming device, and separation tone patches 130. Operation of the method proceeds to step S2040.

In step S2040, the surface potential of the latent image on the photoconductor layer is measured using a sensor such as a non-contact ESV sensor at, for example, the separation tone patches 130. Operation of the method proceeds to step S2050.

In step S2050, the latent charge image on the photoconductor layer is developed into a toner image by toner developer 7. Operation of the method proceeds to step S2060.

In step S2060, the surface potential of the toner image on the photoconductor layer, is measured using a sensor such as a non-contact ESV sensor at, for example, the separation tone patches 130. Operation of the method proceeds to step S2070.

In step S2070, the change in surface potential (ΔV) due to the development of the toner image 120 and the separation tone patches 130 is calculated by subtracting the surface voltage measured in step S2040 from the surface voltage measured in step S2060. Operation of the method proceeds to step S2080.

In step S2080, the mass per unit area of toner particles $$\left(\frac{m}{a}\right)$$

in the toner image is measured at, for example, the separation tone patches 130. Operation of the method proceeds to step S2090.

In step S2090, the value of the dielectric thickness of the toner ($t_{d(toner)}$) is read. The value may be read from a predetermined value stored in the image forming device, a predetermined value stored in a toner cartage or a predetermined value stored on a network connected to the image forming device. Operation of the method proceeds to step S2100.

In step S2100, the values of ΔV, $$\frac{m}{a},$$

$t_{d(toner)}$ and $t_{d(PR)}$ are substituted into Equation 12 to determine the absolute toner charge to toner mass ratio $$\left(\frac{q_{toner}}{m_{toner}}\right).$$

Operation of the method proceeds to step S2110.

Step S2110 is a determination step. In step S2110, the absolute toner charge to toner mass ratio $$\left(\frac{q_{toner}}{m_{toner}}\right)$$

is compared to a first predetermined absolute toner charge to toner mass ratio range. If the absolute toner charge to toner mass ratio $$\left(\frac{q_{toner}}{m_{toner}}\right)$$

is within the first predetermined absolute toner charge to toner mass ratio range, the method then proceeds to step S2140. If the absolute toner charge to toner mass ratio $$\left(\frac{q_{toner}}{m_{toner}}\right)$$

is outside of the first predetermined absolute toner charge to toner mass ratio the operation of the method proceeds to step S2120.

Step S2120 is a determination step. In step S2120, the absolute toner charge to toner mass ratio $$\left(\frac{q_{toner}}{m_{toner}}\right)$$

is compared to a second predetermined absolute toner charge to toner mass ratio range that is wider than the first predetermined absolute toner charge to toner mass ratio range. If the absolute toner charge to toner mass ratio $$\left(\frac{q_{toner}}{m_{toner}}\right)$$

is within the second predetermined absolute toner charge to toner mass ratio range, the method proceeds to step S2150. If the absolute toner charge to toner mass ratio $$\left(\frac{q_{toner}}{m_{toner}}\right)$$

is outside of the second predetermined absolute toner charge to toner mass ratio range the operation of the method proceeds to step S2130.

In step S2130, the image forming device outputs a warning indicating that the absolute toner charge to toner mass ratio $$\left(\frac{q_{toner}}{m_{toner}}\right)$$

is out of specification and that images will not be formed further, the image forming device inhibits the forming of further images until maintenance is performed. The method then proceeds to step S2160 where the method ceases.

In step S2140, the image forming device updates values compensating for changes in the absolute toner charge to toner mass ratio $$\left(\frac{q_{toner}}{m_{toner}}\right).$$

The method then proceeds to step S2160 where the method ceases.

In step S2150, the image forming device outputs a warning indicating that the absolute toner charge to toner mass ratio $$\left(\frac{q_{toner}}{m_{toner}}\right)$$

is not within specification. The method then proceeds to step S2160 where the method ceases.

The above method steps S2110 and S2120 may also be configured to compare the photoconductor layer dielectric thickness ($t_{d(PR)}$) to first and second predetermined photoconductor layer dielectric thickness ranges or method steps S2110 and S2120 may be configured to compare the absolute toner charge to toner mass ratio $$\left(\frac{q_{toner}}{m_{toner}}\right)$$

and photoconductor layer dielectric thickness ($t_{d(PR)}$) to first and second safe operating areas and shown in FIG. 6.

Figure 9:
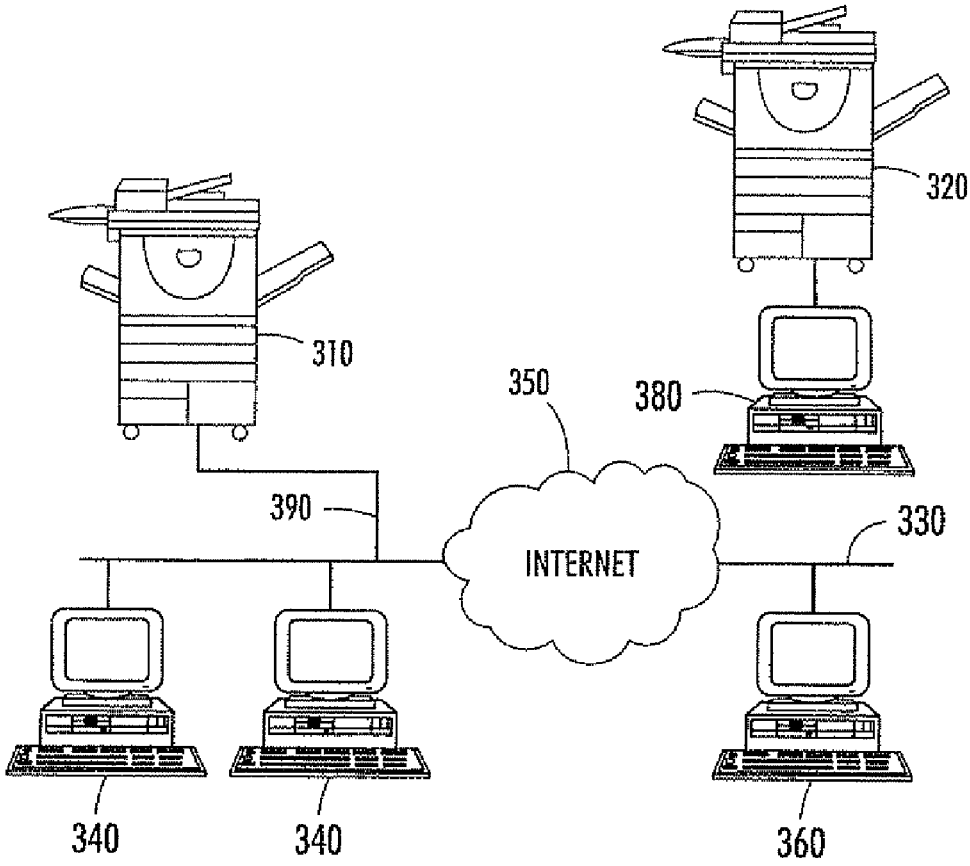
FIG. 9 illustrates an exemplary embodiment of a system of image forming devices and monitoring devices connected via networks and the Internet.

FIG. 9 shows an environment where systems and methods for measuring absolute toner charge to toner mass ratio and photoconductor layer dielectric thickness in an image forming device and reporting changes detrimental to IQ systems and methods may be used. Image forming device 310 is connected to computer network 390. Also connected to computer network 390 are computer terminals 340. Computer network 390 may also be connected to the Internet 350 and from the Internet 350 to a second computer network 330 with, for example, computer terminals or devices 360 connected to that network. Image forming device 320 may be connected only to a single computer or terminal 380. The connections of image forming device 310 and 320 to other computer terminals allows any of the above warnings or messages to be communicated to these computer terminals.

In the case of image forming device 320, the results of the measurement and any warning may also be sent to computer terminal device 380 for display. Because image forming device 310 is connected to network 390 and Internet 350, the results of the measurement and any warning may be sent to any of the devices 340 and 360 connected to network 390 and Internet 350. A network administrator or service agent within a particular company, or an external service agent on the Internet, or the manufacturer of the image forming device, for example, may be informed of the current state of the toner. The network administrator, service agent or manufacturer may then be in a position to take action to remedy the issue with the toner, either by communicating with the image forming device directly over a network to change parameters within the device, or by calling or sending a service agent to examine and replace the toner or photoconductor cylinder, or belt 100.

It will be appreciated that variations of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for monitoring absolute charge to mass ratio of toner in an image forming device, comprising:

acquiring a dielectric thickness of a photoconductor layer;

forming a latent charge image on a surface of the photoconductor layer;

measuring a first surface potential of the latent charge image on the surface of the photoconductor layer;

developing the latent charge image with toner to form a toner image on the photoconductor layer;

measuring a second surface potential of the surface of the toner image on the photoconductor layer;

measuring the mass per unit area of the toner forming the toner image on the photoconductor layer;

determining, based on the dielectric thickness of the photoconductor layer, the first surface potential, the second surface potential, and the mass per unit area of the toner forming the toner image on the photoconductor layer, the absolute charge to mass ratio of the toner; and outputting a warning to a user if the charge to mass ratio of the toner is outside a first predetermined, range, wherein acquiring the dielectric thickness of the photoconductor layer comprises:

placing a known charge per unit area, using a constant current source, on the photoconductor layer;

measuring a third surface potential caused by the known charge per unit area; and determining a dielectric thickness of the photoconductor layer based on the known charge per unit area and the third surface potential.

2. The method according to claim 1, wherein determining the absolute charge to mass ratio of the toner is based on predetermined properties of the toner input to the image forming device.

3. The method according to claim 1, wherein the absolute charge to mass ratio of the toner, $$\frac{q_{toner}}{m_{toner}}$$

is deter mined using the equation $$\frac{q_{toner}}{m_{toner}} = \frac{\varepsilon_o}{t_{Deff}} \frac{\Delta V}{m/a}$$

where $\in_0$ is the dielectric constant of free space, ΔV is a difference between the second surface potential and the first surface potential, $t_{D\ eff}$ is a dielectric thickness of the photoconductor layer and the toner image and $$m/a$$

is the mass per unit area of the toner forming the toner image.

4. The method according to claim 3, wherein dielectric thickness of the photoconductor layer and the toner image $t_{D\ eff}$, is determined by the equation $$t_{D\ eff} = t_{d(PR)} + t_{d(toner)}$$

where $t_{d(PR)}$ is the dielectric thickness of a photoconductor layer and $t_{d(toner)}$ is a dielectric thickness of the toner image.

5. The method according to claim 4, wherein the dielectric thickness of the toner image $t_{d(toner)}$, is determined by the equation $$t_{d(toner)} = \frac{0.32 r_{toner}}{\kappa_{toner}}$$

where $r_{toner}$ is a radius of the toner particles and $\kappa_{toner}$ is the relative dielectric constant of the toner particle materials.

6. The method according to claim 1, wherein the dielectric thickness of the photoconductor layer $t_{d(PR)}$, is determined by the equation $$t_{d(PR)} = \frac{\varepsilon_o V}{I} \frac{a}{t}$$

where $Å_0$ is the dielectric constant of free space, V is a difference between the third surface potential and a voltage on an inner conductor, I is a value of the constant current, $$\frac{a}{t}$$

is an area per unit time of the image forming device.

7. The method according to claim 1, wherein the image forming device adjusts a condition for forming images based on the determined charge to mass ratio of the toner.

8. The method according to claim 1, wherein the image forming device inhibits formation of images if the absolute charge to mass ratio of the toner is outside of a second predetermined range.

9. The method according to claim 1, wherein the image forming device adjusts a condition for forming images based on the determined dielectric thickness of the photoconductor layer.

10. A system for monitoring absolute charge to mass ratio of toner in an image forming device, the image forming device comprising:

an acquiring unit that acquires a dielectric thickness of a photoconductor layer;

an image forming unit that forms a latent charge image on a surface of the photoconductor layer;

a first electrostatic voltage sensor that measures a first surface potential of the latent charge image on the surface of the photoconductor layer;

a development unit that develops the latent charge image with toner to form a toner image on the photoconductor layer;

a second electrostatic voltage sensor that measures a second surface potential of the surface of the toner image on the photoconductor layer;

a measuring unit that measures the mass per unit area of the toner forming the toner image on the photoconductor layer;

a determining unit that determines the absolute charge to mass ratio of the toner based on the dielectric thickness of the photoconductor layer, the first surface potential, the second surface potential, and the mass per unit area of the toner forming the toner image on the photoconductor layer; and an output unit that outputs a warning to a user if the charge to mass ratio of the toner is outside a first predetermined range, wherein the acquiring unit comprises:

a constant current source that places a known charge per unit area, on the photoconductor layer;

a third electrostatic voltage sensor that measures a third surface potential caused by the known charge per unit area; and dielectric thickness determining unit that determines the dielectric thickness of the photoconductor layer based on the known charge per unit area and the third surface potential.

11. The system according to claim 10, wherein a determining unit determines the absolute charge to mass ratio of the toner based on predetermined properties of the toner input to the image forming device.

12. The system according to claim 10, wherein the determining unit determines the absolute charge to mass ratio of the toner, $$\frac{q_{toner}}{m_{toner}}$$

by using the equation $$\frac{q_{toner}}{m_{toner}} = \frac{\varepsilon_o}{t_{Deff}} \frac{\Delta V}{m/a}$$

where $\in_0$ is the dielectric constant of free space, ΔV is a difference between the second surface potential and the first surface potential, $t_{D\ eff}$ is a dielectric thickness of the photoconductor layer and the toner image and $$m/a$$

is the mass per unit area of the toner forming the toner image.

13. The system according to claim 12, wherein dielectric thickness of the photoconductor layer and the toner image $t_{D\ eff}$, is determined by the equation $$t_{D\ eff} = t_{d(PR)} + t_{d(toner)}$$

where $t_{d(PR)}$ is the dielectric thickness of a photoconductor layer and $t_{d(toner)}$ is a dielectric thickness of the toner image.

14. The system according to claim 13, wherein the dielectric thickness of the toner image $t_{d(toner)}$ is determined by the equation $$t_{d(toner)} = \frac{0.32 r_{toner}}{\kappa_{toner}}$$

where $r_{toner}$ is a radius of the toner particles and $\kappa_{toner}$ is the relative dielectric constant of the toner particle materials.

15. The method according to claim 10, wherein the dielectric thickness determining unit determines the dielectric thickness of the photoconductor layer $t_{d(PR)}$, by the using the equation $$t_{d(PR)} = \frac{\varepsilon_o V}{I} \frac{a}{t}$$

where $\in_0$ is the dielectric constant of free space, V is a difference between the third surface potential and a voltage on an inner conductor, I is a value of the constant current, a/t is an area per unit time of the image forming device.

16. The system according to claim 10, wherein the image forming device adjusts a condition for forming images based on the determined charge to mass ratio of the toner.

17. The system according to claim 10, wherein the image forming device inhibits formation of images if the charge to mass ratio of the toner is outside of a second predetermined range.

18. The system according to claim 10, wherein the image forming device adjusts a condition for forming images based on the determined dielectric thickness of the photoconductor layer.

* * * * *